United States Patent [19]

Schweizer et al.

[11] 3,933,363

[45] Jan. 20, 1976

[54] SAFETY SKI BINDING

[75] Inventors: Gottfried Schweizer, Vienna; Josef Svoboda, Schwechat, both of Austria

[73] Assignee: Gertsch AG, Zug, Switzerland

[22] Filed: Sept. 30, 1974

[21] Appl. No.: 510,605

[30] Foreign Application Priority Data

Oct. 4, 1973 Austria ..... 8496/73

[52] U.S. Cl. ..... 280/11.35 T

[51] Int. Cl.[2] ..... A63C 9/08

[58] Field of Search ..... 280/11.35 T

[56] References Cited

UNITED STATES PATENTS

| | | | |
|---|---|---|---|
| 3,610,650 | 6/1969 | Korger | 280/11.35 T |
| 3,773,341 | 11/1973 | Mimeur | 280/11.35 T |
| 3,778,073 | 12/1973 | Salomon | 280/11.35 T |
| 3,836,163 | 7/1974 | Hashioka | 280/11.35 T |

*Primary Examiner*—Robert R. Song

*Attorney, Agent, or Firm*—Woodhams, Blanchard and Flynn

[57] ABSTRACT

A safety ski binding having a sole holder pivotally secured to a base member. The sole holder is held in condition of use by a locking member, which locking member is engaged by a locking part. The locking part is urged into engagement with the locking member by a spring. The locking part is guided in a limited manner in a guideway provided on a support part, which support part is pivotally secured to the base. The support part carries both the spring and a shaft on which the release lever is pivotally secured. The locking member has a notch and a recess therein, the locking part being urged into engagement with the notch while the ski binding is in the condition of use and in the recess when the ski binding is in the position to receive the ski boot therein.

10 Claims, 4 Drawing Figures

SAFETY SKI BINDING

FIELD OF THE INVENTION

The invention relates to a safety ski binding having a pivotal sole holder, which in condition of use holds the ski boot on the ski and can be opened voluntarily, for example with the ski pole, whereby the sole holder is held in condition of use by a locking member, which locking member is engaged by a locking part loaded by a spring, which locking part is connected to a pivotal release lever.

BACKGROUND OF THE INVENTION

A ski binding of this general type is already known (from Austrian Pat. No. 275 372) and has also been proven to be successful in practice. In that patent, the locking spring always acts onto the sole holder. Upon operation of the release lever, the lock is completely freed, however, the release lever itself remains under the influence of the spring and thus also the sole holder.

The purpose of the invention is now to produce a further development at which both the locking member and also the sole holder, upon operation of the release lever, entirely leave the effective range of the locking spring. This purpose is attained by supporting the locking part for movement in a limited manner in a guideway of a support part. The support part is supported pivotally about an axis and carries both the spring and also a further shaft. The release lever is pivotally supported on the further shaft. The locking member has a notch therein into which is received the locking part and following the notch a recess is provided on the locking member.

BRIEF DESCRIPTION OF THE DRAWING

The subject matter of the invention is illustrated in one exemplary embodiment in the drawing, in which.

DETAILED DESCRIPTION

Figure 4:
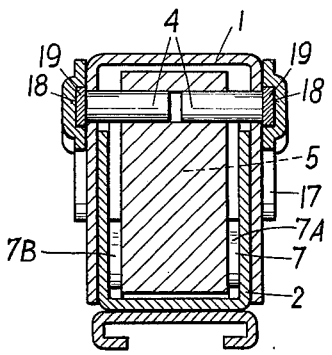
FIG. 4 is a cross-sectional view along the line IV—IV of FIG. 1.

As one can recognize in the drawing, the sole holder 1 is pivotally supported for movement about an axis 3 which is arranged in the base member 2. The sole holder has mounted thereon a pair of independent and coaxial shafts 4 which pivotally support a locking member 5 depending downwardly therefrom. The locking member 5 has a tongue 5A which grips under a locking projection 6 secured to the base member 2. Furthermore, a U-shaped constructed support part 7 is pivotally supported for movement about the axis 3. The support part 7 has a pair of parallel arms or side members 7A and 7B (FIG. 4), each of which has a longitudinal slot 8 therein. Each longitudinal slot 8 forms a guide for locking part 9. The locking part 9 has a recess in the area between the side members and a spring abutment 10 is provided in the recess. A locking spring 11 is supported at one end against the spring abutment 10. The other end of the spring 11 is supported on a spring abutment 12, which can be adjusted in axial direction of the spring 11 by means of a screw 21 which is rotatably supported in the support part 7.

Figure 1:
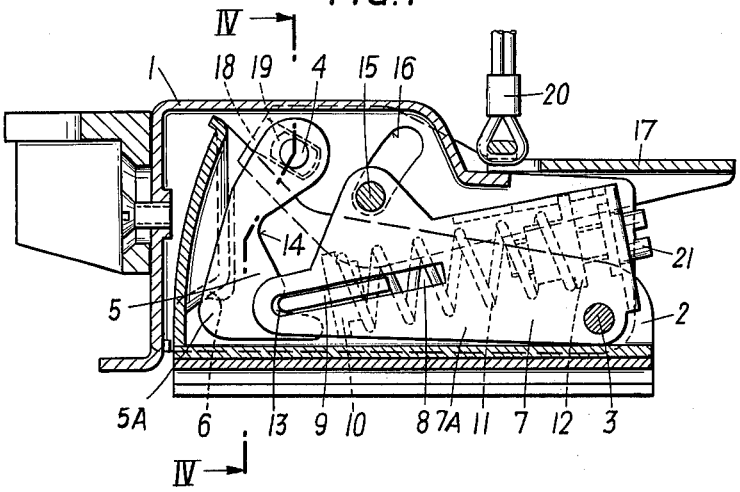
FIG. 1 is a cross-sectional view of an inventively constructed heel binding.

The locking member 5 also has a notch 13 therein which is adapted to receive the locking part 9 therein. The locking part 9 is pressed into the notch 13 and into a condition of use, as illustrated in FIG. 1, by the spring 11. A recess 14 is provided above the notch 13 on the locking member 5. The recess 14 functions as a free position, so that the locking member 5, in the unlocked position, can swing away from the locking projection 6 on the base member 2 through the release lever 17.

A shaft 15 is mounted on the support part 7. The release lever 17 is pivotally supported on the shaft 15. The shaft 15 penetrates through slotted holes 16 in the sole holder 1, which holes are concentric with respect to the pivot axis 3. The release lever 17 has also guideways 18 at its front end and forwardly of the shaft 15. Sliding members 19 mounted at the remote ends of the two shafts 4 are received in the guideways 18. Thus, the sliding members 19 form the support for the release lever during operation of the same. The release lever can be operated by lifting its rear end or by pulling the belt 20 which is connected to it.

Figure 2:
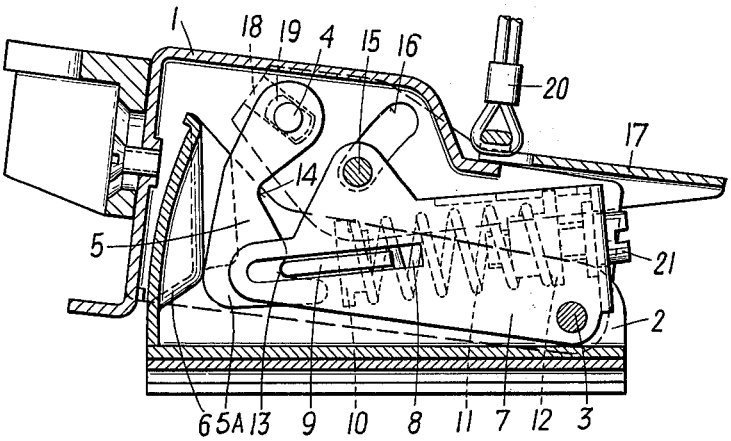
FIG. 2 illustrates the binding in a position during a safety release.

When an overload occurs as for example during a fall, a safety release takes place, as this is illustrated in FIG. 2. The sole holder 1 is hereby pivoted upwardly about the axis 3. Through this movement, the tongue 5A on the locking member 5 slides along the locking projection 6 on the base member 2 and urges the locking part 9 rearwardly against the resistive force of the spring 11 to cause the locking part 9 to move back into the longitudinal slot 8. When the sole holder 1 is moved about the pivot axis 3, the support part 7 is also pivoted about the axis 3 in the same manner, so that the locking member 5 remains, through the locking part 9, under the effect of the spring 11. FIG. 2 illustrates the moment of release. Starting at this point, the spring 11 can begin to relax again, because the locking member 5, when it slides along the vertical part of the locking projection 6, can slightly swing frontwardly. The ski binding remains then in the open position and is generally ready for the boot to enter. As soon as the sole holder 1 is pressed downwardly, the tongue on the blocking member 5 grips under the locking projection 6 under the pressure of the spring 11 and the ski binding assumes the position of use according to FIG. 1.

Figure 3:
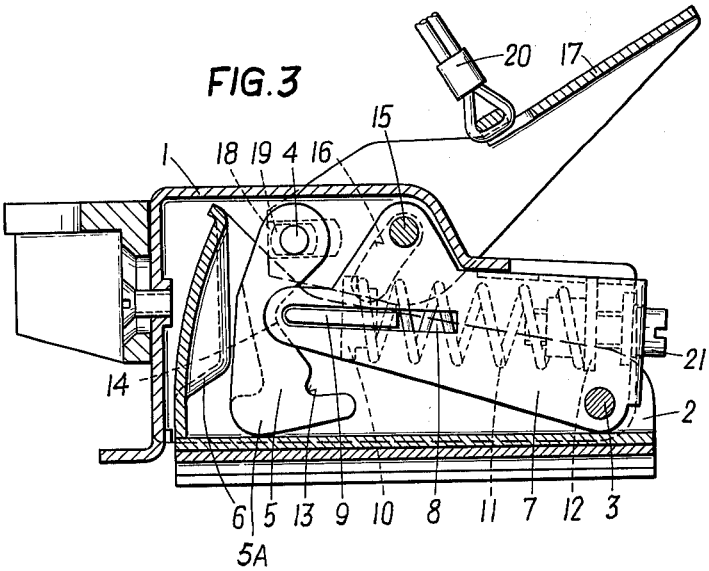
FIG. 3 illustrates the release of the binding after operating the release lever.

For the arbitrary stepping out of the binding, the release lever 17 must be swung upwardly. This can be done for example by pulling up on the belt 20 as illustrated in FIG. 3. The release lever 17 is thereby pivotally supported on the sliding members 19 which slides in the guideways 18 during such movement and the shaft 15 moves upwardly in the concentric longitudinal slots 16. The shaft 15 pivots the support part 7 about the axis 3, through which the locking part 9 disengages the notch 13 of the locking member 5. The movement of the locking part 9 is limited by the ends of the longitudinal slots 8, said locking part 9 now abutting the ends of the slots 8 under the pressure of the spring 11. The locking member 5 can now practically swing freely, until the lowermost point of the recess 14 of the locking member 5 contacts the locking part 9. Locking member 5 and locking projection 6 are now, as can be seen in FIG. 3, completely free from one another and the sole holder 1 can freely pivot about the axis 3. If the release lever 17 is pressed downwardly, it also swings the support part 7 downwardly, which causes the locking part 9 to engage the notch 13 of the locking member 5 and the tongue 5A of the locking member 5 again grips under the locking projection 6 of the base member 2, so that the position of use according to FIG. 1 is obtained.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding, comprising:

a base member having means defining a locking projection thereon;

sole holder means pivotally supported to said base member for movement about a first pivot axis;

support means pivotally supported to said base member for movement about a second pivot axis, said support means including guide means thereon and a movable locking part guided for movement by said guide means;

a locking member pivotally supported on said sole holder means, said locking member having a recess therein receiving said locking projection when said sole holder means is in a position of use;

resilient means mounted on and movable with said support means, said resilient means being positioned between and engaging said support means and said locking part to resiliently urge said locking part into engagement with said locking member so that said locking member is also urged by said resilient means into engagement with said locking projection, said locking projection being maintained in said recess by the force of said resilient means; and release lever means pivotally supported on said sole holder means for movement between first and second limits about a third pivot axis, said release lever means including securement means for securing said release lever means to said support means, whereby a pivoting movement of said release lever means about said third pivot axis will effect a pivoting movement of said support means about said second pivot axis to prevent said resilient means from resiliently urging said locking part into engagement with said locking member so that said sole holder is free to pivot about said first pivot axis.

2. A safety ski binding according to claim 1, wherein said locking member has a pair of spaced pockets thereon separate from said recess, said locking part being urged, when said sole holder means is in said position of use and said release lever means is at said first limit, into one of said pockets to urge said locking projection into said recess and into the other of said pockets when said release lever means is at said second limit.

3. A safety ski binding according to claim 1, wherein said first and second pivot axes are one and the same pivot axis.

4. A safety ski binding according to claim 1, wherein said release lever means is movable relative to said third pivot axis, said release lever means having at least one slotted guideway therein and a slide slidably received in said guideway, said third pivot axis being defined by at least one pin secured to said slide.

5. A safety ski binding according to claim 4, wherein said securement means includes an elongated slot in said sole holder means receiving a pin secured to said release lever means, said pin being connected to said support means.

6. A safety ski binding according to claim 5, wherein said elongated slot is arcuate and concentric about said second pivot axis.

7. A safety ski binding according to claim 4, wherein said release lever means includes a pair of arms straddling said sole holder means, each of said arms having one of said slotted guideways thereon, said third pivot axis being defined by a pair of axially aligned pins, each being secured to a slide in one of said guideways.

8. A safety ski binding according to claim 1, wherein said support means is generally U-shaped having a pair of parallel arms;

wherein said guide means comprises an elongated slot in each of said parallel arms, said locking part being slidingly received in both of said slots.

9. A safety ski binding according to claim 8, wherein said resilient means is a spring extending between a bight portion of said U-shaped support means and said locking part.

10. A safety ski binding, comprising:

a base member having means defining one of a locking projection and recess thereon;

sole holder means pivotally supported to said base member for movement about a first pivot axis;

support means pivotally supported to said base member for movement about a second pivot axis, said support means including a movable locking part thereon;

a locking member pivotally supported on said sole holder means, said locking member having the other of said locking projections and said recess thereon and engaging said one of said locking projection and said recess when said sole holder means is in a position of use;

resilient means mounted on and movable with said support means, said resilient means being positioned between and engaging said support means and said locking part to resiliently urge said locking part into engagement with said locking member so that said locking member is also urged by said resilient means into engagement with said one of said locking projection and said recess, one of said locking projection and said recess being maintained in engagement with said other of said locking projection and said recess by the force of said resilient means; and release lever means pivotally supported on said sole holder means for movement between first and second limits about a third pivot axis, said release lever means including securement means for securing said release lever means to said support means, whereby a pivoting movement of said release lever means about said third pivot axis will effect a pivoting movement of said support means about said second pivot axis to prevent said resilient means from resiliently urging said locking part into engagement with said locking member so that said sole holder is free to pivot about said first pivot axis.

* * * * *